US012035821B2

(12) United States Patent
McAndrew

(10) Patent No.: US 12,035,821 B2
(45) **Date of Patent: *Jul. 16, 2024**

(54) REFRIGERATORS

(71) Applicant: Aerofoil Energy Limited, Macclesfield (GB)

(72) Inventor: Paul McAndrew, Macclesfield (GB)

(73) Assignee: Aerofoil Energy Limited, Macclesfield (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/446,621

(22) Filed: Aug. 9, 2023

(65) Prior Publication Data

US 2024/0016315 A1 Jan. 18, 2024

Related U.S. Application Data

(63) Continuation of application No. 14/783,636, filed as application No. PCT/GB2014/051102 on Apr. 9, 2014, now Pat. No. 11,759,031.

(30) Foreign Application Priority Data

Apr. 11, 2013 (GB) ..... 13066121

(51) Int. Cl.

| | |
|---|---|
| ***A47F 3/04*** | (2006.01) |
| ***F25D 23/02*** | (2006.01) |
| ***F25D 25/02*** | (2006.01) |

(52) U.S. Cl.

CPC ..... *A47F 3/0447* (2013.01); *A47F 3/0469* (2013.01); *F25D 23/023* (2013.01); *F25D 25/02* (2013.01); *F25D 2317/063* (2013.01)

(58) Field of Classification Search

CPC ..... A47F 3/0447; F25D 23/023

See application file for complete search history.

(56) References Cited

U.S. PATENT DOCUMENTS

| | | | |
|---|---|---|---|
| 1,727,698 | A | 9/1929 | Clouse |
| 2,387,622 | A | 10/1945 | Tanner |

(Continued)

FOREIGN PATENT DOCUMENTS

| | | | |
|---|---|---|---|
| CN | 101031225 | A | 9/2007 |
| DE | 69813806 | T2 | 4/2004 |

(Continued)

OTHER PUBLICATIONS

Combined Search Report and Examination Report for GB 1613334.0, mailed on Jan. 31, 2017, 4 pages.

(Continued)

*Primary Examiner* — Allen R. B. Schult

(74) *Attorney, Agent, or Firm* — Price Heneveld LLP

(57) ABSTRACT

A refrigerator has an open front and an air curtain system having at least one upper air egress with an outer edge and at least one lower air-recovery ingress. The air curtain system is adapted to produce a substantially vertical air curtain over at least part of the open front of the refrigerator. The refrigerator comprises at least one shelf between the egress and the ingress, the shelf having a front edge, and at least one elongate air-guiding strip extending across at least part of the open front of the fridge. The strip is located substantially in the plane of the shelf and spaced from the front edge of the shelf. The strip is located substantially vertically beneath the outer edge of the upper air egress.

19 Claims, 13 Drawing Sheets

(56) References Cited

U.S. PATENT DOCUMENTS

| | | | |
|---|---|---|---|
| 2,822,672 | A | 2/1958 | Dickson |
| 3,063,253 | A | 11/1962 | Dickson |
| 3,747,726 | A | 7/1973 | Walter |
| 4,265,090 | A | 5/1981 | Abraham |
| 4,467,512 | A | 8/1984 | Modes |
| 4,476,615 | A | 10/1984 | Cook |
| 8,729,429 | B2 | 5/2014 | Nuttall et al. |
| D719,194 | S | 12/2014 | Lee et al. |
| D731,562 | S | 6/2015 | You et al. |
| D737,344 | S | 8/2015 | Lee et al. |
| D748,167 | S | 1/2016 | Lee et al. |
| D749,654 | S | 2/2016 | Lee et al. |
| D751,126 | S | 3/2016 | Pfaff |
| D777,225 | S | 1/2017 | McAndrew |
| D797,164 | S | 9/2017 | Jo et al. |
| 2005/0217297 | A1 | 10/2005 | Wilson |
| 2007/0251253 | A1 | 11/2007 | Alahyari et al. |
| 2008/0205040 | A1 | 8/2008 | Shibusawa |
| 2008/0236182 | A1 | 10/2008 | Hahn et al. |
| 2011/0049119 | A1 | 3/2011 | Nuttall et al. |
| 2012/0092350 | A1 | 4/2012 | Ganapathi |
| 2014/0263134 | A1 | 9/2014 | Walker et al. |
| 2015/0374142 | A1 | 12/2015 | Wirth |
| 2016/0278542 | A1 | 9/2016 | Eget et al. |
| 2020/0184904 | A1 | 6/2020 | Jung et al. |

FOREIGN PATENT DOCUMENTS

| | | | |
|---|---|---|---|
| EP | 0441357 | A2 | 8/1991 |
| EP | 1839535 | A2 | 10/2007 |
| EP | 1508288 | B1 | 7/2013 |
| FR | 2690825 | A1 | 11/1993 |
| GB | 2527636 | A | 12/2015 |
| JP | S51150569 | U | 12/1976 |
| JP | S55165468 | | 12/1980 |
| JP | S5758884 | | 4/1982 |
| JP | S57152073 | U | 9/1982 |
| JP | S58110977 | A | 7/1983 |
| JP | S59174588 | U | 11/1984 |
| JP | S61196661 | U | 12/1986 |
| JP | S62162569 | U | 10/1987 |
| JP | S63140258 | U | 9/1988 |
| JP | H03263584 | A | 11/1991 |
| JP | H0452481 | A | 2/1992 |
| JP | H07248173 | A | 9/1995 |
| JP | H10339552 | A | 12/1998 |
| JP | 2004278865 | A | 10/2004 |
| JP | 2009300031 | A | 12/2009 |
| JP | 2012161345 | A | 8/2010 |
| JP | 2010207564 | | 9/2010 |
| JP | 2010207565 | A | 9/2010 |
| JP | 2011131036 | A | 7/2011 |
| JP | 20111310136 | A | 7/2011 |
| JP | 2011167384 | A | 9/2011 |
| JP | 2011188889 | A | 9/2011 |
| JP | 2012161345 | A | 8/2012 |
| JP | 2012231826 | A | 11/2012 |
| JP | 2014108180 | A | 6/2014 |
| JP | 2014198069 | A | 10/2014 |
| JP | 2017029604 | A | 2/2017 |
| WO | 2012112115 | A1 | 8/2012 |

OTHER PUBLICATIONS

Office Action for Design U.S. Appl. No. 29/509,239, mailed on Apr. 19, 2016, 7 pages.

International Search Report and Written Opinion for International Application No. PCT/GB2016/053698, mailed on Feb. 16, 2017, 10 pages.

International Search Report and Written Opinion for International Application No. PCT/GB2017/051366 mailed on Aug. 9, 2017, 13 pages.

International Search Report and Written Opinion for International Application No. PCT/GB2018/050582 mailed on May 25, 2018, 9 pages.

International Search Report and Written Opinion for International Application No. PCT/GB2018/000049 mailed on May 4, 2018, 11 pages.

International Search Report and Written Opinion for International Application No. PCT/GB2018/000060 mailed on Jun. 11, 2018, 10 pages.

Office Action issued in Japanese Patent Application No. 2016-507055 mailed on Feb. 27, 2018, 3 pages.

Search Report for United Kingdom Application No. GB1705605.2 mailed Jul. 5, 2017, 5 pages.

Search Report for United Kingdom Application No. GB1715593.8 mailed Mar. 19, 2018, 5 pages.

Search Report for United Kingdom Application No. GB1608586.2 mailed Nov. 1, 2016, 1 page.

Search Report for United Kingdom Application No. GB1703813.4 mailed Jun. 29, 2017, 4 pages.

Search Report for Chinese Application No. 2014800207039 dated Apr. 11, 2013, 3 pages.

Extended Search Report for European Application No. 21205106.4 mailed Mar. 9, 2022, 9 pages.

REFRIGERATORS

CROSS-REFERENCE TO RELATED APPLICATIONS

This application is a continuation of U.S. patent application Ser. No. 14/783,636, filed Oct. 9, 2015, entitled "IMPROVEMENTS IN REFRIGERATORS," which is a National Stage Application of International Application No. PCT/GB2014/051102, filed Apr. 9, 2014, which claims the priority of British Application No. 1306612.1, filed Apr. 11, 2013, the entire disclosures of which are hereby incorporated by reference in their entirety.

BACKGROUND OF THE INVENTION

The present invention relates to improvements in refrigerators.

Open-fronted refrigerators are used in a variety of commercial settings, in particular supermarkets and grocery stores. The purpose of an open-fronted refrigerator is to allow customers to readily access the chilled goods stored therein, which can be of particular benefit in shops with high footfalls as they are easy to shop from and to load into.

However, the significant drawback of open-fronted refrigerators in comparison to refrigerators with closable doors is that they are very energy-inefficient.

One of the prior art ways to reduce the high energy costs of such units being open-fronted is to fit doors or plastic strips which cover the opening completely. But such additions defeat the whole purpose of an open-fronted refrigerator and are a hindrance to shoppers.

Another prior art method to reduce the high energy costs of such units being open-fronted is to provide a cool air curtain across the open front of a unit. With such air curtains cool air is blown downwards from the top of the fridge towards a grill at the base that captures the cool air to recirculate it.

Refrigerator manufacturers are constantly striving to create better air curtain performance For example, some now use a double air curtain, and most refrigerators now blow air through a honeycomb strip at the air-curtain egress (both of these adaptations being exemplified in U.S. Pat. No. 6,094,931).

However, once the cool air leaves the top of a fridge and moves towards the base there is little or nothing that can be done to stop the air curtain mixing with warm air next to it as it travels down across the open face of the fridge. Such mixing is known as 'infiltration'.

Turbulence increases the mixing the warm air outside with the air curtain and leads to additional warm air passing through the air curtain into the interior of the fridge.

Increased infiltration leads to more energy being used by any refrigerator as it strives to maintain the desired temperature in its interior storage space.

The use of air guiding ducts has previously been suggested in EP1508288 wherein deflector plates are provided at a point where two air sources mix so as to divert air that is pumped through shelving into the path of an air curtain.

In JP2011167384 deflector plates are employed to attempt to direct a diagonal air curtain towards an air curtain egress in a refrigerator with moveable shelves so as to mitigate against damage to an air curtain when shelves are moved up or down in the refrigerator.

The present invention seeks to reduce infiltration of air curtains in refrigerators that have substantiality vertical air curtains and thereby reduce energy consumption and the costs associated therewith.

SUMMARY OF THE INVENTION

These and other features, advantages and objects of the present invention will be further understood and appreciated by those skilled in the art by reference to the following specification, claims and appended drawings.

According to a first aspect of the present invention there is provided a refrigerator having an open front, the refrigerator comprising:

- an air curtain system having at least one upper air egress having an outer edge and at least one lower air-recovery ingress, the air curtain system being adapted to produce a substantially vertical air curtain over at least part of the open front of the refrigerator;
- at least one shelf between the egress and the ingress, the shelf having a front edge;
- at least one elongate air-guiding strip extending across at least part of the open front of the fridge;
- the strip being located substantially in the plane of the shelf and spaced from the front edge of the shelf;
- the strip being located substantially vertically beneath the outer edge of the upper air egress.

The provision of at least one air-guiding strip to an open-fronted refrigerator substantially vertically beneath outer edge of the upper air egress has multiple advantages.

Primarily such an air-guiding strip straightens the vertical fall of the air curtain, reducing turbulence and infiltration of warmer air, and thereby increasing the efficiency of the refrigerator.

It has been found that in order to operate effectively the air guide must be located substantially vertically beneath outer edge of the upper air egress such that it is located at or adjacent to the outer edge of the substantially vertical air curtain.

By providing such an arrangement the temperature performance of the fridge may be enhanced, or alternatively if so desired by a user the temperature performance may be maintained but energy savings may be made.

Furthermore, as the air-guiding strip is located substantially only in the plane of shelf, the improved performance or energy savings are effected without putting any barrier in front of merchandise, but instead by using the already unused area occupied by the shelf edges.

Indeed, because each air-guiding strip may be approximately the same height as the shelf behind it, the air-guiding strips do not hinder users from accessing the storage area of the refrigerator in the same manner that doors or vertical see-through plastic strips do.

Having no moving parts and not having to interact with shoppers, the air-guiding strips are less susceptible to being damaged and they cost significantly less than fitting doors.

Thus, the air-guiding strips do not block, obscure or sit in front of product display area, they only block the edge of the shelves.

In some embodiments a shelf-facing surface of the strip is located substantially vertically beneath the outer edge of the upper air egress.

In some embodiments an upper edge of the strip is located substantially vertically beneath the outer edge of the upper air egress.

In some embodiments an air-guiding strip is in the form of an aerofoil.

In some embodiments a pressure surface of the aerofoil is substantially vertically beneath outer edge of the upper air egress.

In some embodiments a leading edge of the aerofoil is substantially vertically beneath outer edge of the upper air egress.

In some embodiments an air-guiding strip extends substantially across the width of the shelf.

In some embodiments an air-guiding strip extends across substantially the full width of the open front of the refrigerator.

Preferably the refrigerator comprises a plurality of air-guiding strips located substantially in the plane of respective shelves.

Preferably an air-guiding strip is located in front of each shelf of the refrigerator.

In some embodiments an air-guiding strip is attached to the shelf or a support for the shelf.

In some embodiments an air-guiding strip is attached to a ticket strip or support for a ticket strip located at the front edge of the shelf.

In some embodiments an air-guiding strip is attached to refrigerator by a plurality of brackets.

In some embodiments at least one bracket is located at or adjacent each end of an air-guiding strip.

In some embodiments an air-guiding strip is retrofit to the refrigerator.

The retrofitting of existing refrigerators allows for the benefits of this technology to be applied to the many refrigerators currently in supermarkets.

In some embodiments an air-guiding strip is formed as part of the refrigerator during manufacture thereof.

In some embodiments at least part of an air-guiding strip is substantially transparent.

By providing substantially transparent air-guiding strips existing product labels may be visible to shoppers therethrough.

In some embodiments at least part of an air-guiding strip is formed of a substantially transparent plastics material.

In some embodiments an air-guiding strip comprises a housing for displaying at least one product label or a plurality of product labels.

By providing an air-guiding strip that comprises a housing for displaying product labels the air-guiding strip can be formed at least in part from any desired opaque material such as metal.

In some embodiments an air-guiding strip comprises a backing portion and a front portion.

In some embodiments a backing portion is formed of metal.

In some embodiments a front portion comprises a housing for displaying at least one product label or a plurality of product labels.

In some embodiments a front portion is formed of a transparent plastics material.

In some embodiments a backing portion and a front portion together form an aerofoil.

In some embodiments the air-guiding strip comprises an electronic display.

In some embodiments an air-guiding strip is at least 2 mm in thickness.

In some embodiments an air-guiding strip is at least 4 mm in thickness.

In some embodiments an air-guiding strip is at least 6 mm in thickness.

In some embodiments an air-guiding strip is at least 8 mm in thickness.

In some embodiments an air-guiding strip is at least 10 mm in thickness.

In some embodiments an air-guiding strip is at least 12 mm in thickness.

In some embodiments an air-guiding strip is at least 14 mm in thickness.

In some embodiments the height of the air-guiding strip is between 25 and 60 mm.

In some embodiments the height of the air-guiding strip is between 35 and 50 mm.

In some embodiments the height of the air-guiding strip is between 40 and 45 mm.

In those embodiments where the air-guiding strip is an aerofoil blade preferably the chord length of the aerofoil blade is between 25 and 60 mm.

In some embodiments the chord length of the aerofoil blade is between 35 and 50 mm.

In some embodiments the chord length of the aerofoil blade is between 40 and 45 mm.

In some embodiments the refrigerator comprises:

adjacent at least one upper shelf at least one air-guiding strip housing at least one product label or a plurality of product labels;

adjacent at least one lower shelf an air-guiding strip that does not house product labels.

In some embodiments the refrigerator comprises:

adjacent a plurality of upper shelves respective air-guiding strips housing at least one product label or a plurality of product labels;

adjacent a plurality of lower shelves respective air-guiding strips that do not house product labels.

In some embodiments adjacent a plurality of lower shelves the respective air-guiding strips are substantially transparent.

According to a second aspect of the present invention there is provided a method of refrigeration comprising the step of operating a refrigerator according to any variation of the first aspect of the present invention.

According to a third aspect of the present invention there is provided an air-guiding strip attachment adapted to be attached to a refrigerator so as to construct a refrigerator in accordance with any variation of the first aspect of the present invention.

According to a fourth aspect of the present invention there is provided a method of improving the efficiency of a refrigerator comprising the steps of:

providing at least one air-guiding strip attachment for a refrigerator; and attaching the air-guiding strip to the refrigerator so as to form a refrigerator in accordance with any variation of the first aspect of the present invention.

DETAILED DESCRIPTION OF PREFERRED EMBODIMENT

Figure 1:
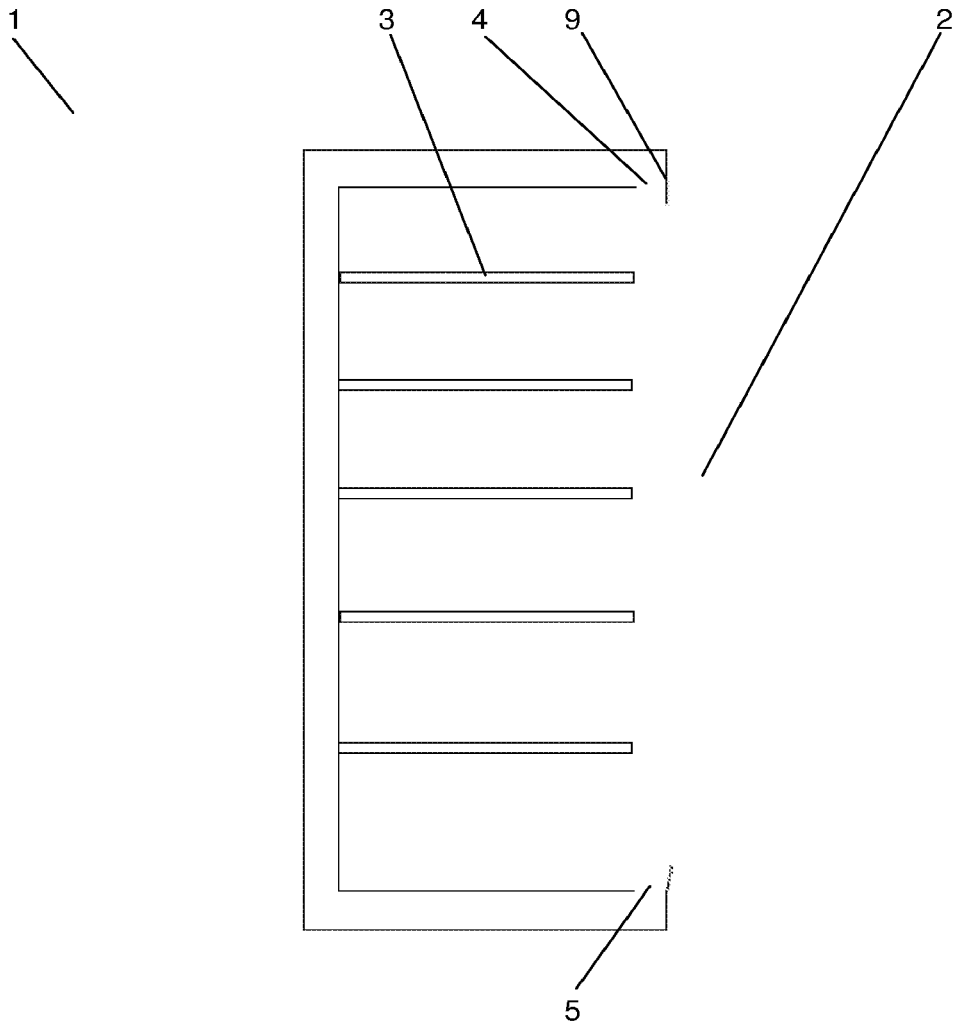
FIG. 1 is a schematic cross-section of a standard prior-art open-fronted refrigeration unit.

The above description is considered that of the preferred embodiment(s) only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

Referring to the drawings, FIG. 1 shows a standard open-fronted refrigerator 1 having an open front 2 and a plurality of shelves 3. Refrigerator 1 comprises an air curtain system having an air egress 4 at its top and located above the open front of the refrigerator and an air recovery ingress 5 located below egress 4.

Various other elements of the air curtain system exist, but such systems are so well-known in the art that further discussion thereof is not considered necessary.

The air curtain system of refrigerator 1 is adapted to pass an air curtain of cooled air between air egress 4 and air recovery ingress 5 such that the air curtain passes in front of shelves 3 so as to increase the efficiency of refrigerator 1.

Air egress 4 has an outer edge 9, and an air curtain expelled from air egress 4 therefore directly after expulsion from egress 4 has its front edge substantially in line with outer edge 9.

Figure 3:
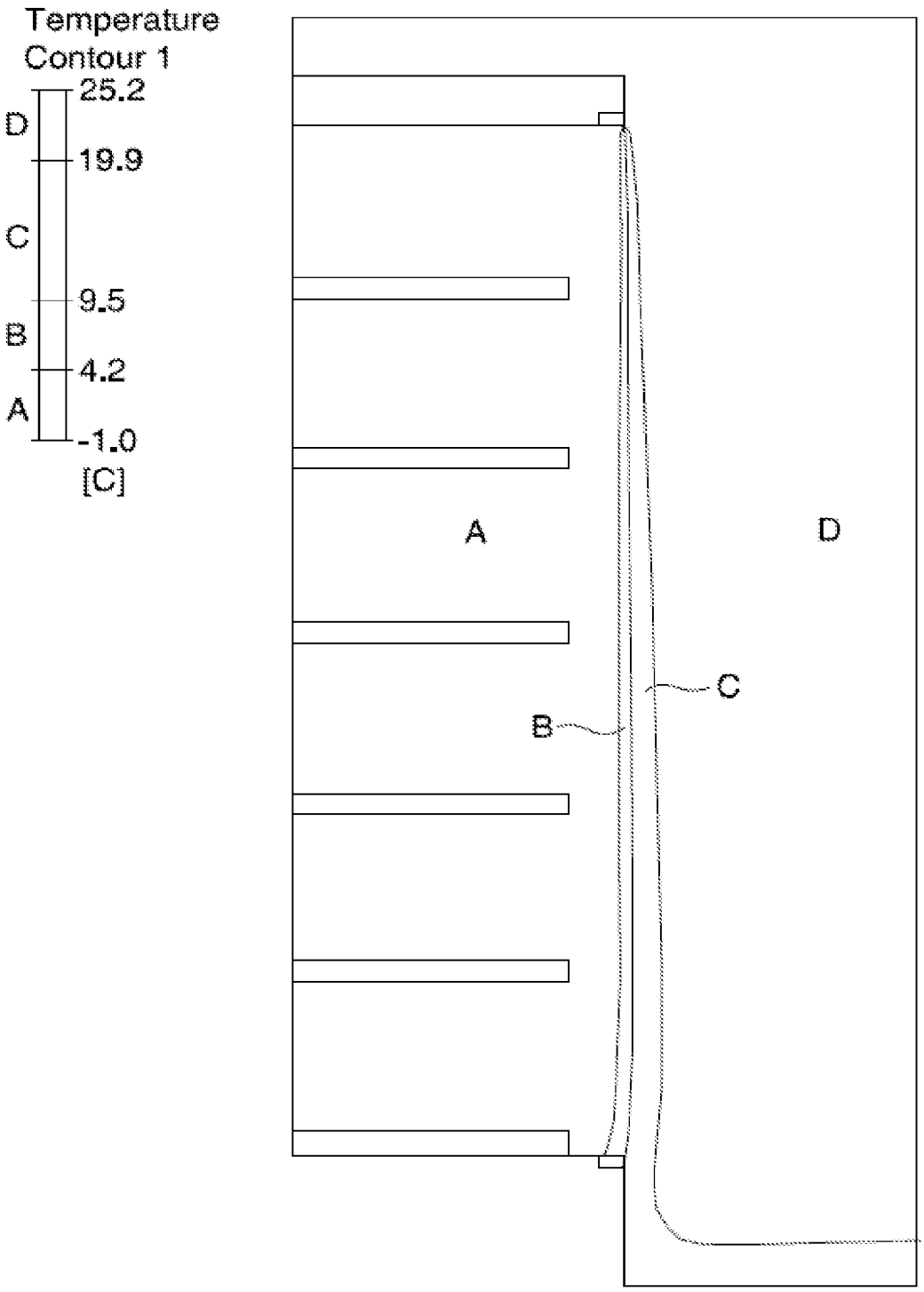
FIG. 3 is a schematic diagram illustrating by means of a temperature profile how a vertical air curtain disperses as its progresses downwards on a standard open-fronted refrigerator.

However, as can be seen in FIG. 3 as the air curtain progresses downwards it gradually becomes more dispersed owing to turbulence, and the front edge of the air curtain becomes more difficult to define, but in effect moves outwards. It can be seen how the air curtain of a standard prior art refrigerator is therefore less effective near the air ingress in comparison to adjacent its air egress.

Figure 2:
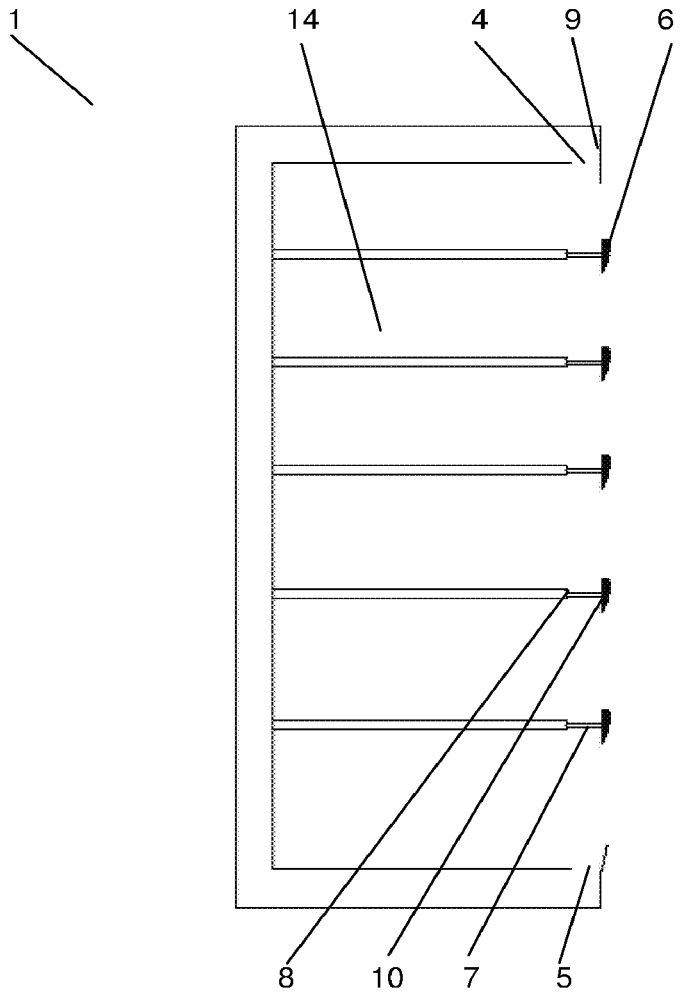
FIG. 2 is a schematic cross-section of the refrigerator of FIG. 1 adapted in accordance with the present invention.

Referring to FIG. 2 wherein the refrigerator of FIG. 1 has been fitted with a retrofit air-guiding strips 6 in accordance with the present invention, each shelf 3 has had attached thereto an elongate air-guiding strip 6, which is attached to its respective shelf 3 by means of brackets 7. Brackets 7 attach the ends of air-guiding strip 6 to the ends to the supports for shelf 3.

Figure 5:
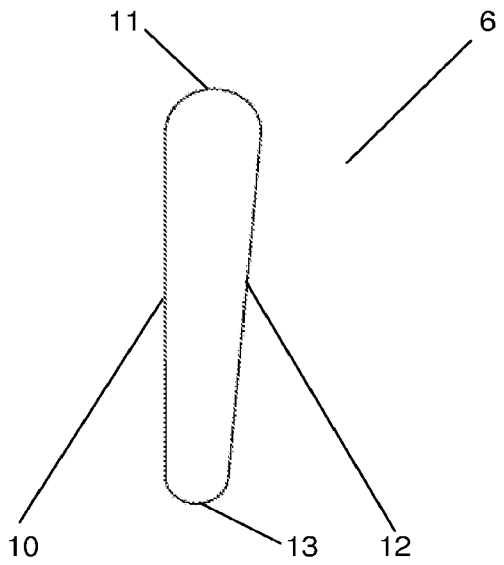
FIG. 5 is schematic cross-section of a first embodiment of an air-guiding strip.
Figure 6:
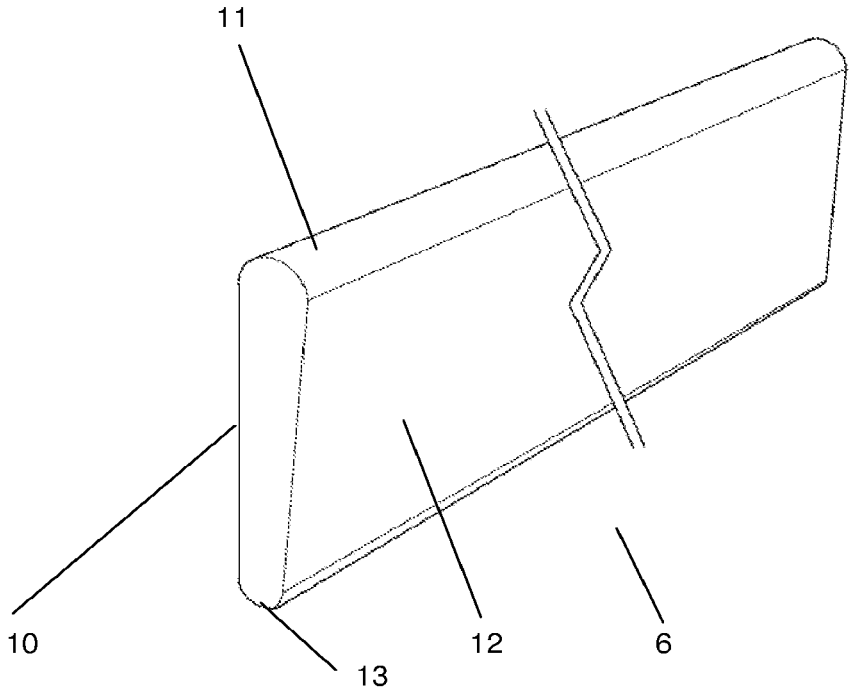
FIG. 6 is a schematic perspective view of the strip of FIG. 3.
Figure 7:
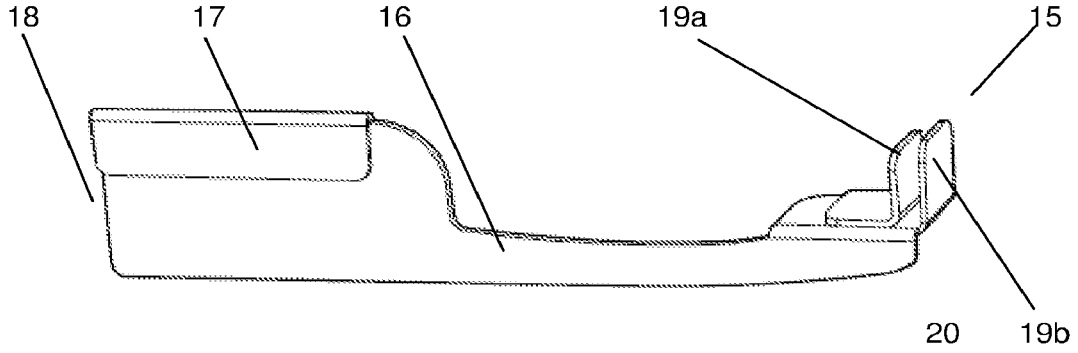
FIG. 7 is a schematic perspective view of a first embodiment of a bracket for attaching an air-guiding strip to a refrigerator.

Referring to FIGS. 5 and 6, air-guiding strip 6 is in the present embodiment in the form of an aerofoil blade, having a leading edge 11, lower surface (also known as a 'pressure surface') 10 which faces front edge 8 of shelf 3 and an upper surface (also known as a 'suction surface') 12 which faces outwardly from the storage space 13 of the refrigerator such that when refrigerator is in use upper surface 12 faces a user.

In the present embodiment air-guiding strip is around 9 mm in maximum thickness (i.e. between lower surface 10 and upper surface 12.

In the present embodiment air-guiding strip is around 45 mm in height (i.e. between leading edge 11 and trailing edge 13.

Air-guiding strip 6 is spaced from the front edge 8 of shelf 3 such that its pressure surface 10 sits substantially vertically beneath outer edge 9 of air egress 4.

Leading edge 11 of air-guiding strip 6 faces the flow of air being expelled from air egress 4.

In use, with refrigerator 1 fitted with the air-guiding strips 6 of the present invention runs substantiality as normal, except that the air curtain that passes between egress 4 and ingress 5 is guided down the open front 2 of the refrigerator by the air-guiding strips 6.

Air-guiding strips 6 act stabilize the flow of the air curtain and hinder dispersal of the air curtain as air flows between air egress 4 and air ingress 5. Air-guiding members 6 do this by guiding air that is moving out of the stream of the air curtain back into it.

Thus air-guiding strips with an aerofoil profile have been found to be ideal, although other shapes of air-guiding strips have been found to have some effect, particularly if the strip is at least 4 mm in thickness, more preferably at least 6 mm in thickness and even more preferably at least 8 mm in thickness.

Figure 4:
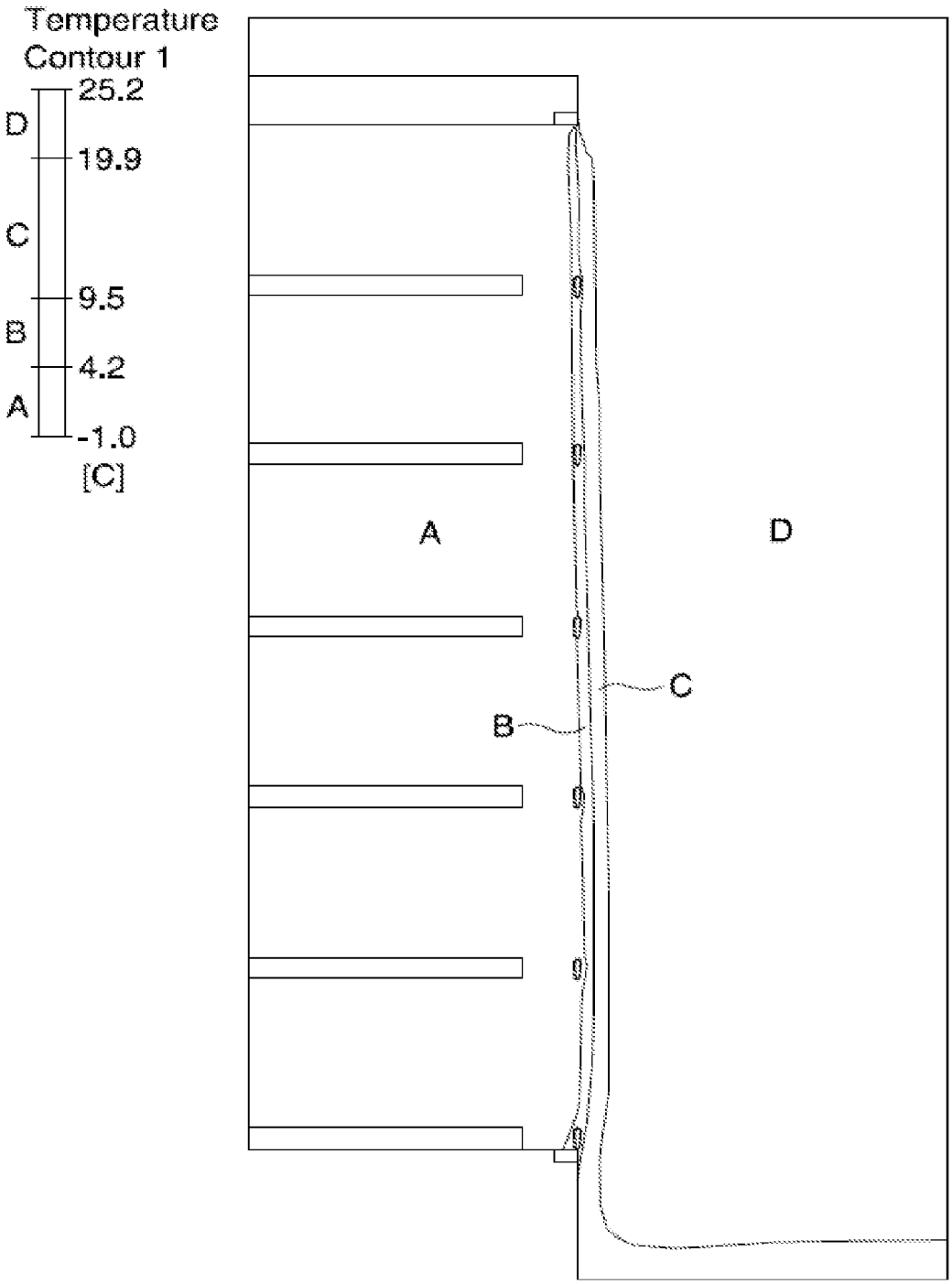
FIG. 4 is a schematic diagram illustrating by means of a temperature profile how the air curtain of a refrigerator adapted in accordance with the present invention disperses less as its progresses downwards.

As can be seen in FIG. 4 when air-guiding strips 6 are fitted to a refrigerator 1 the air curtain is more contained with less dispersal thereof as air flows down towards egress 5.

Beneficially, with air-guiding strips 6 in place a refrigerator 1 is able to be stocked as normal and users are able to remove products from the storage space 14 of refrigerator 1 as access to storage space 14 on shelves 3 is not hindered by air-guiding strips 6 as they each lie substantially in the same plane as shelves 3.

It will be apparent that the optimal positioning of air-guiding strip 6 will! depend upon the particular refrigerator with which the strip 6 is being used. in the present embodiment it has been found that positioning the air-guiding strip located substantially vertically beneath outer edge of the upper air egress seems to be preferable.

Turning to FIGS. 7 to 10 and a first embodiment of a bracket that may be used to attach air-guiding strip 6 to a refrigerator, bracket 15 comprises an elongate arm 16 having a hook portion 17 adjacent a first end 18 and two projections 19*a*, 19*b* adjacent an opposite second end 20 adapted to retain therebetween air-guiding strip 6.

An air-guiding strip 6 may be secured between projections 19*a*, 19*b* by any suitable means such as adhesive, a nut and bolt, or a grub screw.

Figure 8:
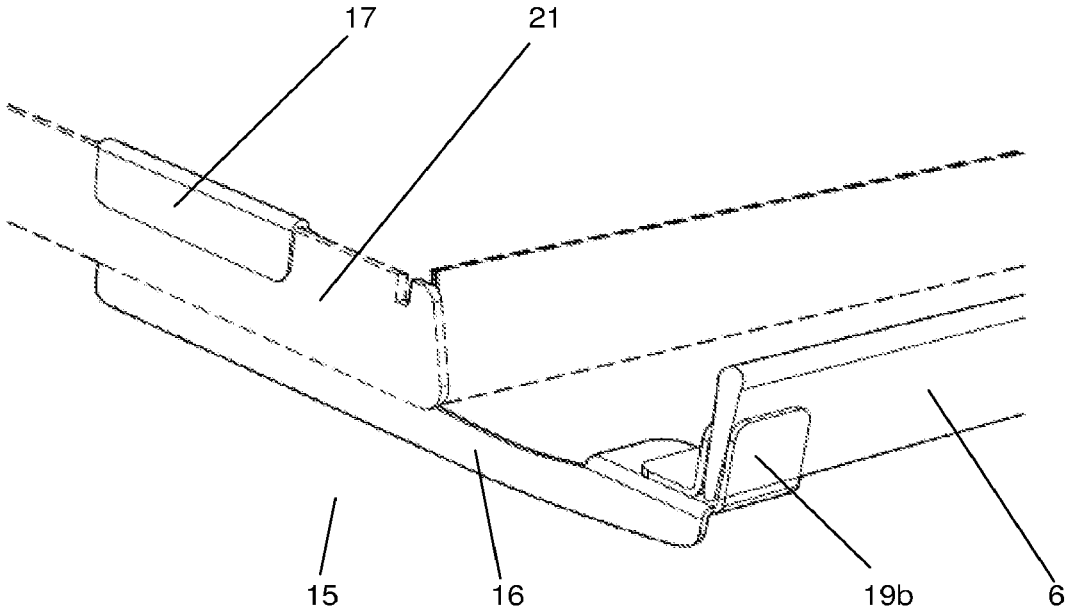
FIG. 8 is a schematic perspective view of the bracket of FIG. 5 attached to a shelf support on a refrigerator.
Figure 9:
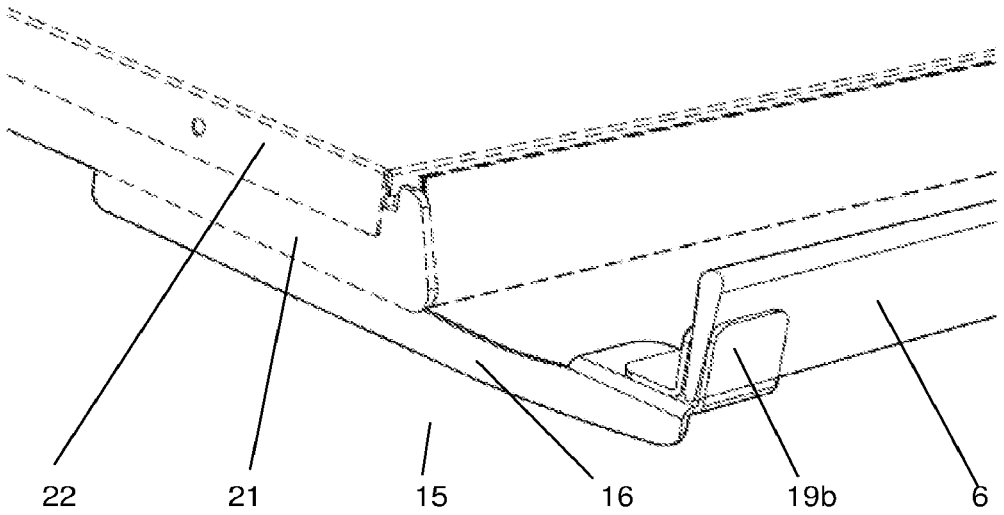
FIG. 9 is a schematic perspective view of the bracket of FIG. 5 attached to a shelf support on a refrigerator with a shelf in place.

As can be seen in FIGS. 8 and 9, hook portion 17 of bracket 15 is adapted to tit over an existing shelf support 21, where it may be secured in place by any suitable means such as a nut and bolt or a grub screw. When in place shelf 22 may be repositioned upon shelf support 21.

Figure 10:
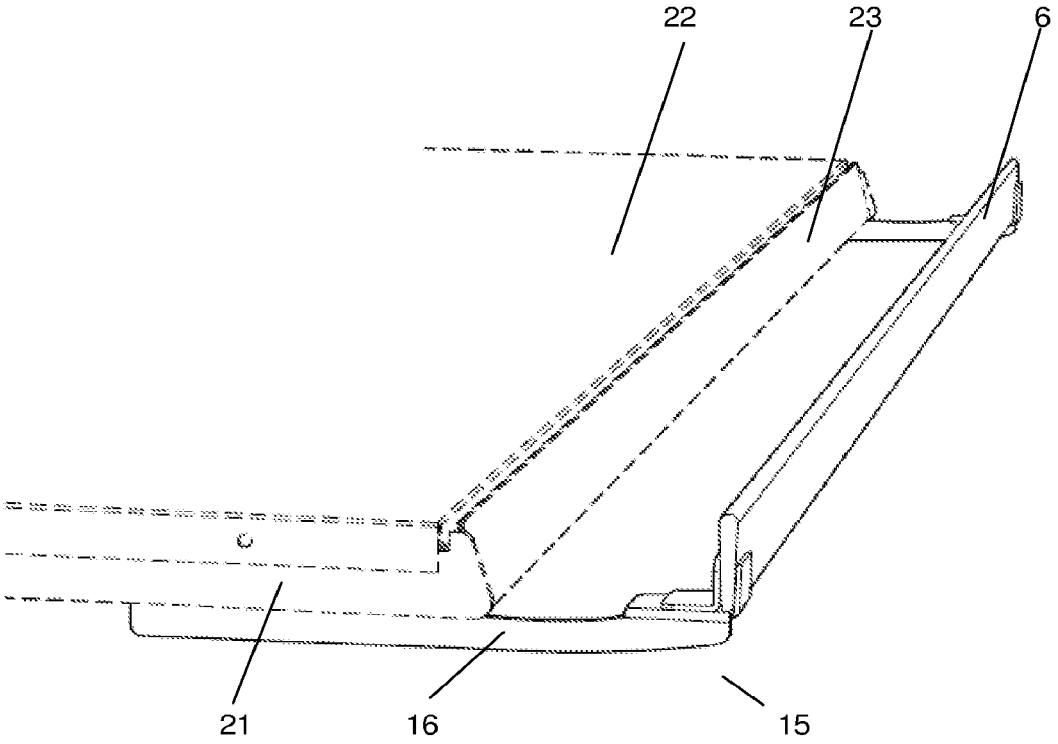
FIG. 10 is a schematic perspective view of an air-guiding strip attached to a refrigerator by means of the first embodiment of brackets.

As best seen in FIG. 10, air-guiding strip 6 extends substantially across the full width of shelf 3. In the present embodiment as refrigerator 1 has only a single stack of shelves air-guiding strip 6 therefore extends substantially across the full width of the open front of refrigerator 1.

It will be apparent that it is preferable for any air-guiding strip to extend substantially across the width of the air curtain, which in most refrigerators extend themselves across the full width of their open fronts. It will also be apparent that in order to span the width of the open front of a refrigerator two or more air-guiding strips could be used. Such an arrangement may be ideal for refrigerators that have more than one stack of shelves.

It will also be apparent that in some embodiments air-guiding strips that do not substantially span the width of the open face of a refrigerator could be used, but such arrangements are not preferred.

Air-guiding strip 6 lies substantially in the plane of shelf 22 and therefore also substantially in the plane of ticket strip 23 wherein prices of goods stored on shelf 22 may be retained and displayed. In order that ticket strip 23 is not obscured from view air-guiding strip 6 is formed of a substantially transparent plastics material, allowing shoppers to see ticket strip 23 through air-guiding strip 6.

Figure 11:
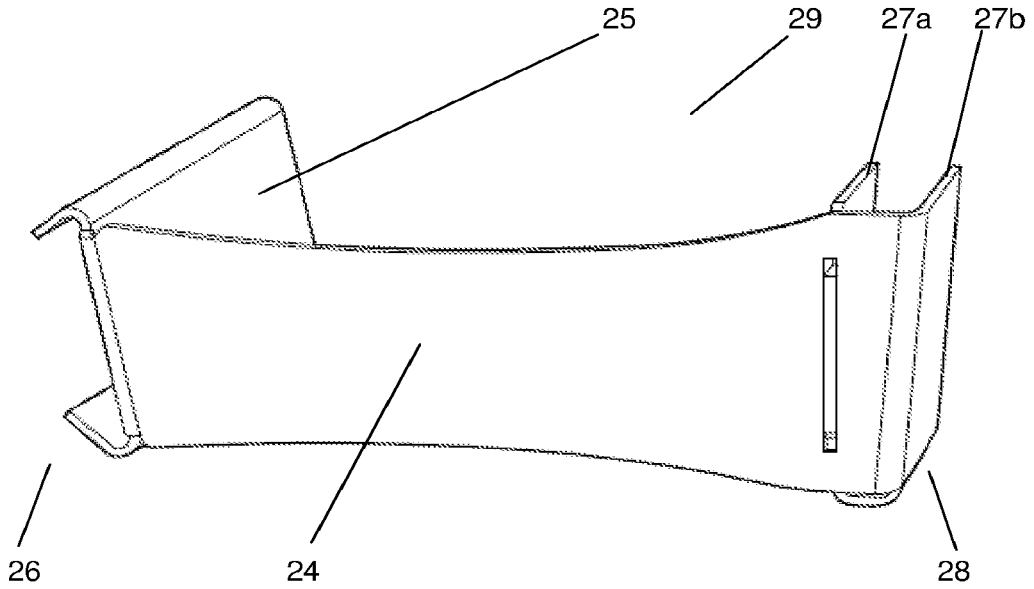
FIG. 11 is a schematic perspective view of a second embodiment of a bracket for attaching an air-guiding strip to a refrigerator.
Figure 12:
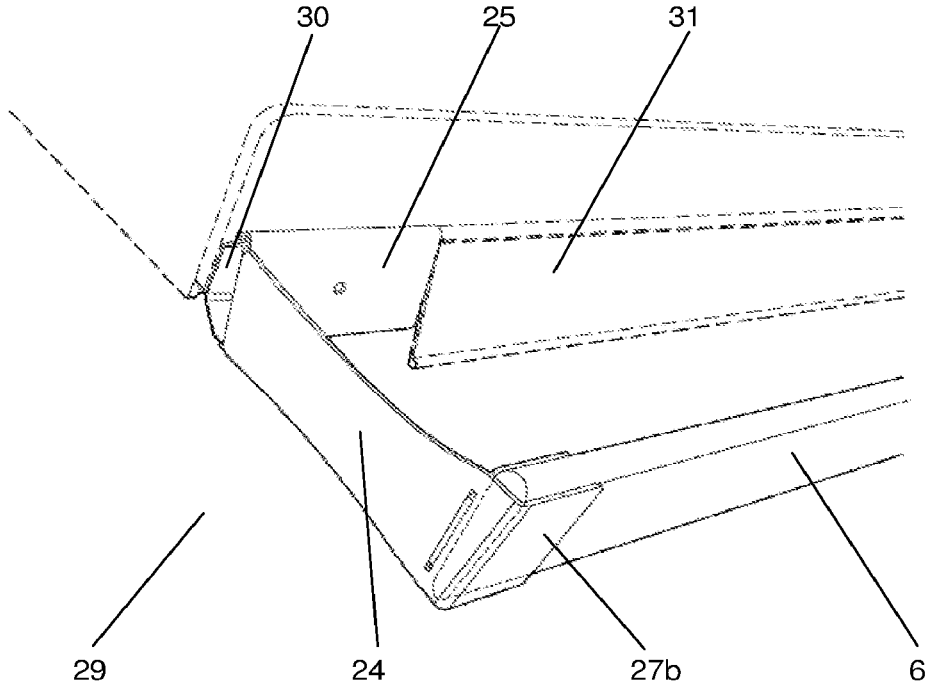
FIG. 12 is a schematic perspective view of the bracket of FIG. 9 attached to a ticket strip support on a refrigerator.
Figure 13:
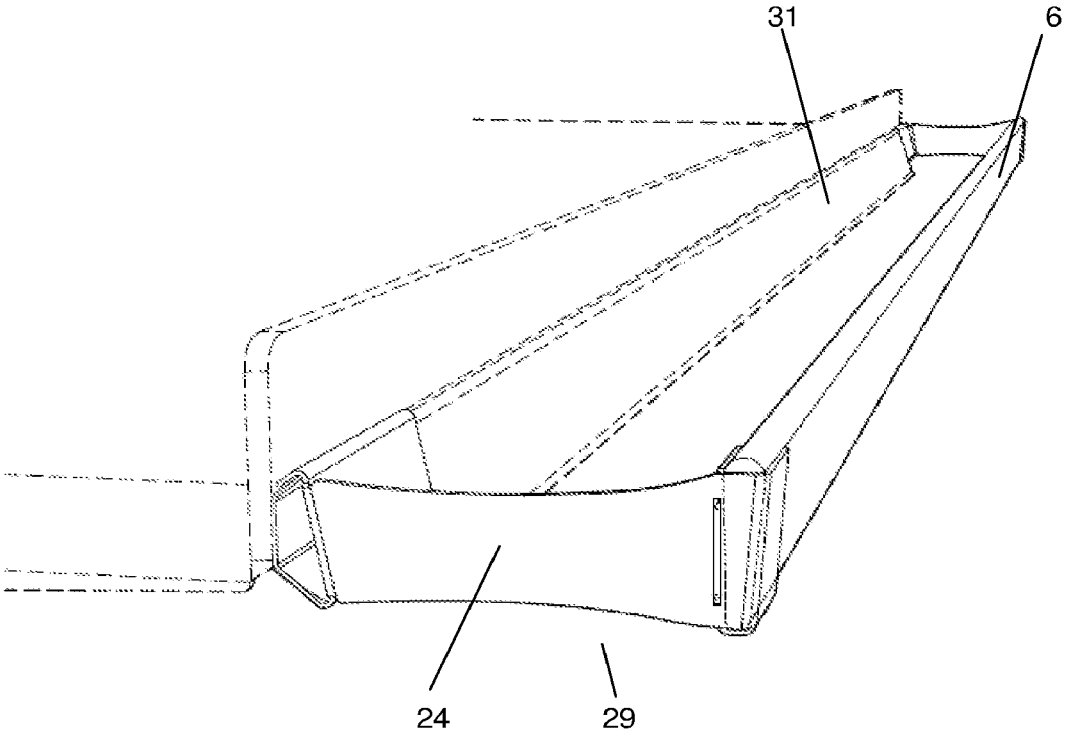
FIG. 13 is a schematic perspective view of an air-guiding strip attached to a refrigerator by means of the second embodiment of brackets.

Turning to FIGS. 11 to 13 and a second embodiment of a bracket that may be used to attach air-guiding strip 6 to a refrigerator, bracket 29 comprises an elongate arm 24 having a clip portion 25 adjacent a first end 26 of elongate arm 24 and substantially orthogonal thereto.

Bracket 29 further comprises two projections 27*a*, 27*b* adjacent an opposite second end 28 of elongate arm 24 adapted to retain therebetween air-guiding strip 6.

An air-guiding strip 6 may be secured between projections 27*a*, 27*b* by any suitable means such as adhesive, a nut and bolt, or a grub screw.

As can be seen in FIG. 12, clip portion 25 of bracket 29 is adapted to clip to an existing support 30 for a ticket strip 31, where it may be secured in place by any suitable means such as a nut and bolt or a grub screw.

It is preferable that when fitted to a refrigerator the air-guiding strip and brackets may not be moved or altered so as to prevent users of the refrigerator unwittingly moving the air-guiding strip away from its optimum position. Thus, it is preferred that when fitted the air-guiding strips are in a substantially fixed position.

Figure 14:
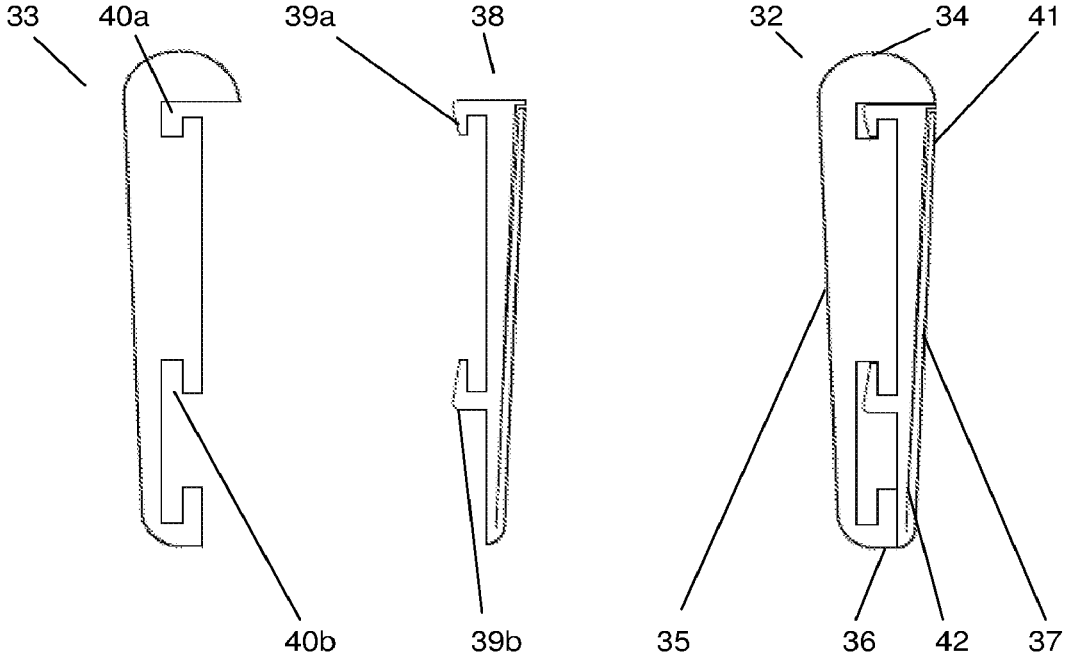
FIG. 14 is a schematic cross-section of a second embodiment of an air-guiding strip showing the two halves of the strip separately and conjoined.
Figure 15:
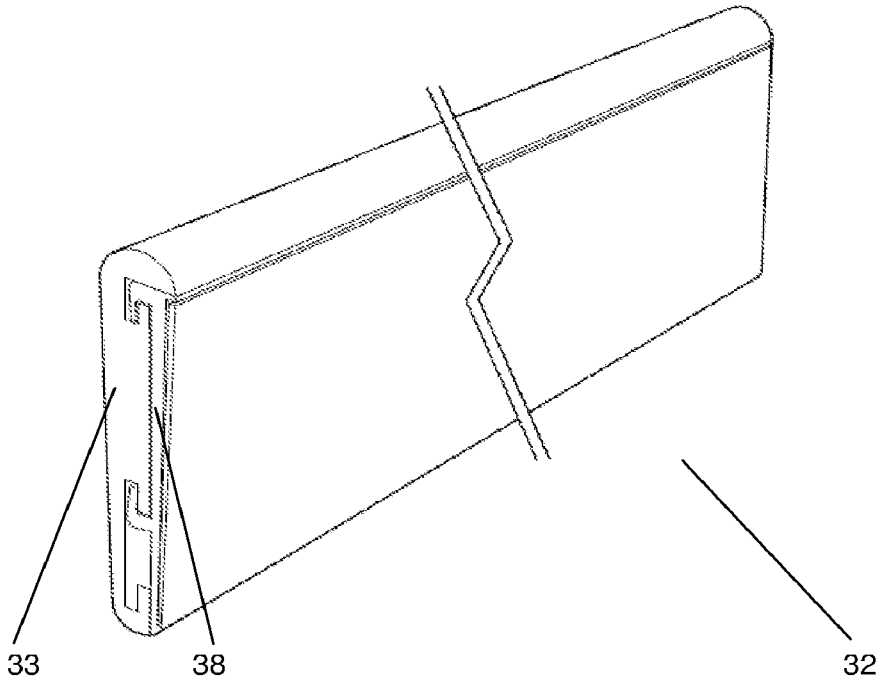
FIG. 15 is a schematic perspective view of the strip of FIG. 12.
Figure 16:
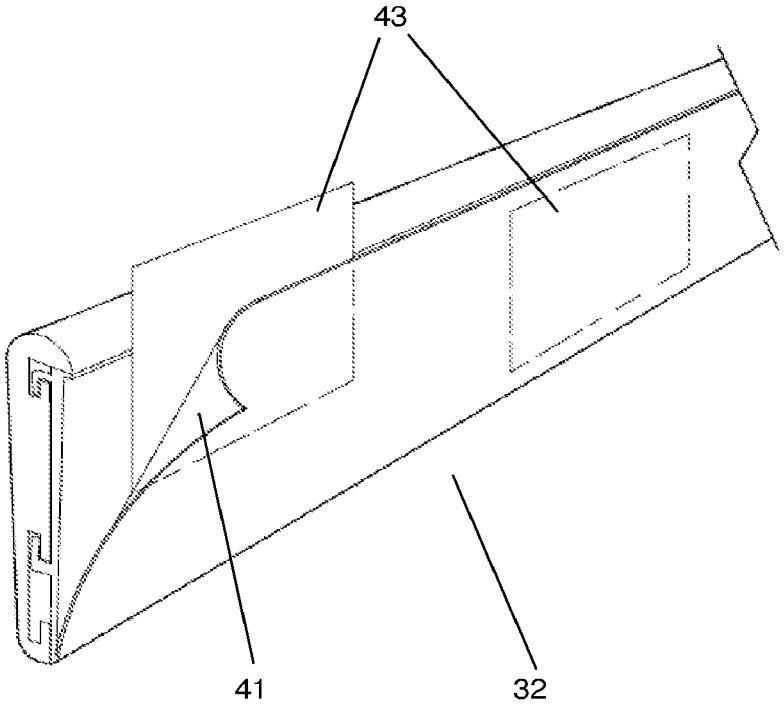
FIG. 16 is a schematic perspective view of the strip of FIG. 12 showing how price labels may be retained thereby.

Turning now to FIGS. 14 to 16 and a second embodiment of an air-guiding strip that may be employed with the present invention, air-guiding strip 32 is also in the shape of an aerofoil, but instead of being formed substantially in one piece of a transparent plastics material is instead formed in two halves.

Backing portion 33 is formed of extruded aluminum and incorporates the leading edge 34, lower surface 35 and trailing edge 36 of an aerofoil.

Front piece 38 is formed of a transparent plastics material and forms the upper surface 37 of an aerofoil.

Front piece 38 comprises projections 39*a*, 39*b* adapted to engage with corresponding recesses 40*a*, 40*b* on backing portion 33 such that front piece 38 may be securely but releasably attached to backing portion 33.

When conjoined backing portion 33 and front piece 39 together form a complete aerofoil.

When air-guiding strip 32 is attached to a refrigerator it is front piece 38 that faces shoppers. Thus, in order that product prices may be displayed to shoppers front piece 38 is adapted to retain a plurality of product labels.

Front piece 38 comprises a transparent flexible cover 41 formed by an incision 42 through the body of front piece 38.

As best illustrated by FIG. 16 flexible cover 41 may be peeled back such that a user may insert product labels 43 into front piece 38, such that they are retained and displayed by air-guiding strip 32. Product labels 43 may be removed and replaced by a user as desired.

Figure 17:
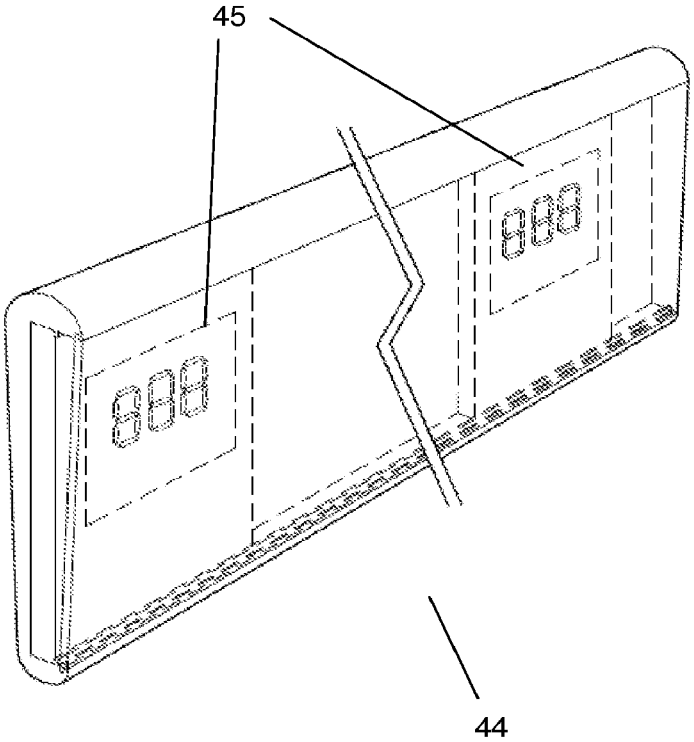
FIG. 17 is a schematic cross-section of a third embodiment of an air-guiding strip comprising an electronic display.

Turning to FIG. 17 and a further embodiment of an air-guiding strip for use with the present invention, air-guiding strip 44 is in the form of an aerofoil and comprises a plurality of electronic price displays 45.

Figure 18:
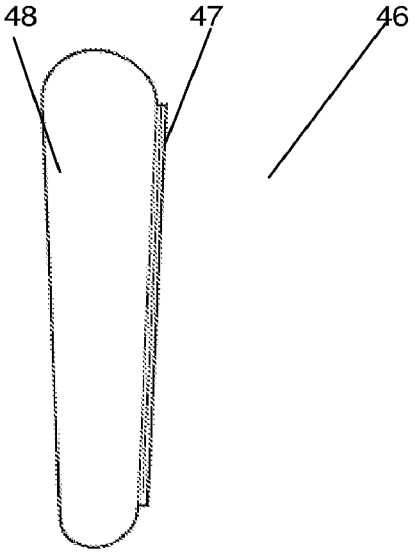
FIG. 18 is a schematic cross-section of a fourth embodiment of an air-guiding strip.
Figure 19:
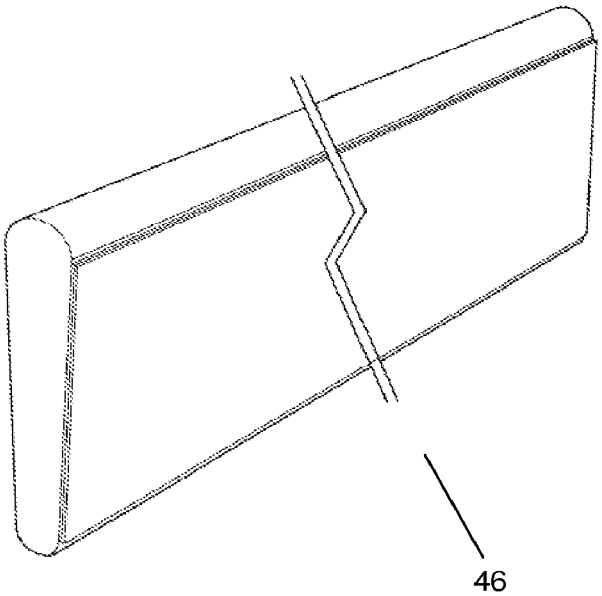
FIG. 19 is a schematic perspective view of the strip of FIG. 18.
Figure 20:
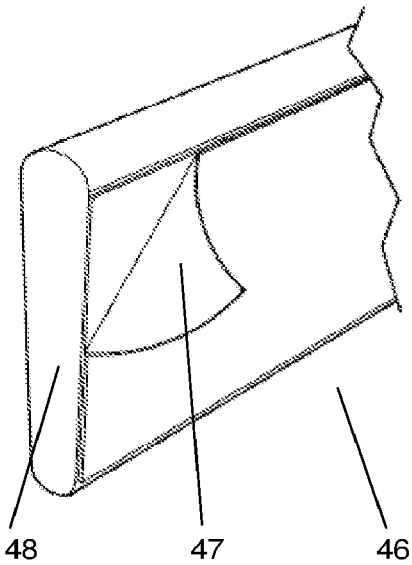
FIG. 20 is a schematic perspective view of the strip of FIG. 18 showing how price labels may be retained thereby.

Turning to FIGS. 18 to 20 and a further embodiment of an air-guiding strip for use with the present invention, air-guiding strip 46 is in the form of an aerofoil and has a main body 48 that has adhered to its upper surface (i.e. the aerofoil surface that faces out from a refrigerator when air-guiding strip 46 is in use) a transparent elastomeric flexible cover 47 that is adapted to releasably retain product labels.

As best illustrated by FIG. 20 flexible cover 47 may be peeled back such that a user may insert product labels {not shown} behind flexible cover, such that they are retained and displayed by air-guiding strip 46. The product labels may be removed and replaced by a user as desired.

Beneficially with this embodiment main body 48 may be formed of any suitable material, and once formed flexible cover 47 may be attached thereto by adhesive.

Figure 21:
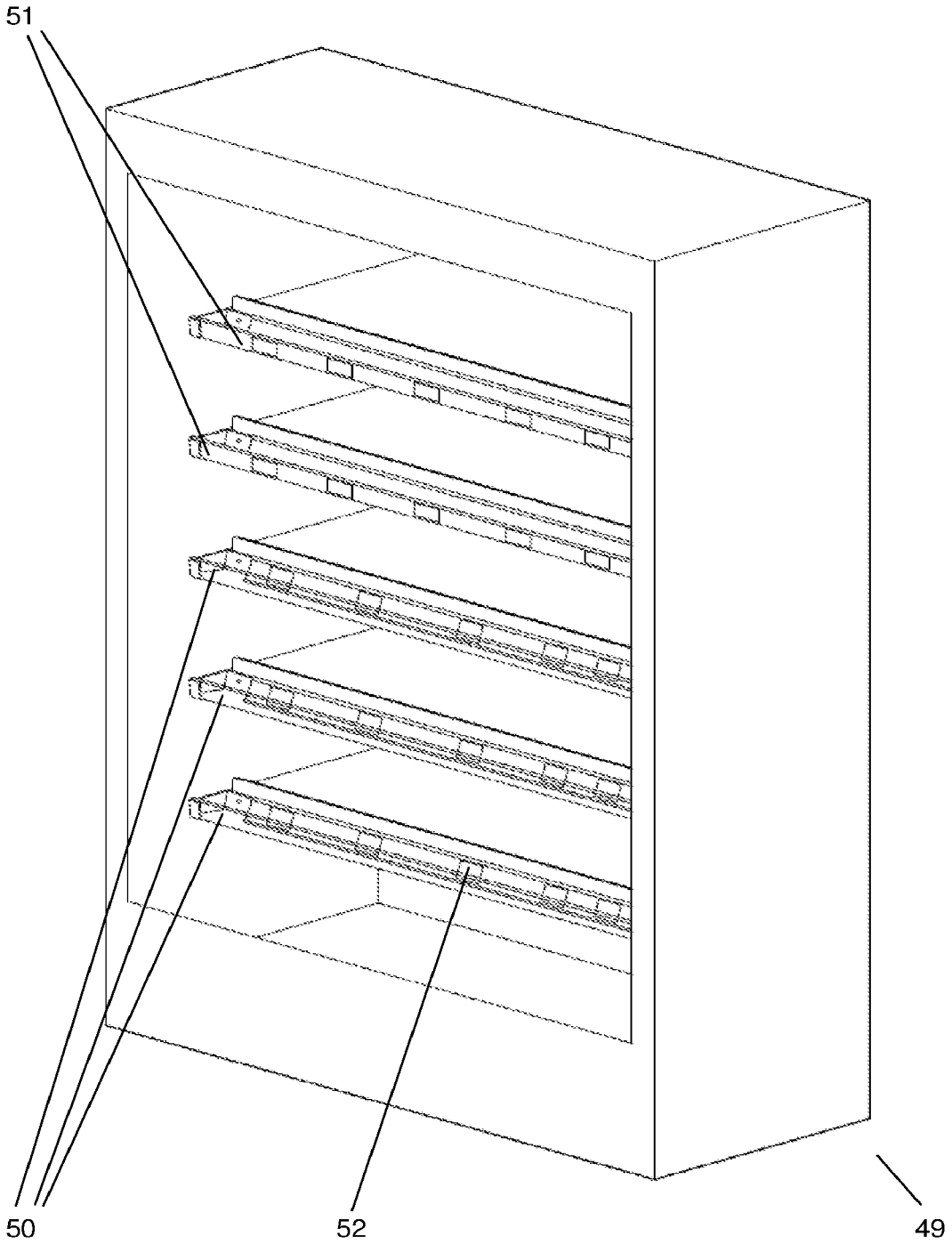
FIG. 21 is a schematic perspective view of a refrigerator having a different types of air-guiding strip attached thereto.

Turning to FIG. 21 and a refrigerator 49 retrofitted with air-guiding strips made in accordance with the present invention, it can be seen that in some circumstances it may be preferable to retrofit a fridge with a variety different types of air-guiding strip.

On the lower three shelves of refrigerator 49 cheaper transparent plastic air-guiding strips 50 have been provided, whereas on the upper two shelves are provided more expensive composite air-guiding members 51 comprising an extruded aluminum backing portion and a frontal transparent product label housing.

The reason for this is that shoppers are able to see original product labels 52 over the top of air-guiding strips fitted to the lower shelves.

However, shoppers cannot see past air-guiding members 51 on the upper shelves that are at or around eye-level.

Thus the upper shelves require product labels to be housed on the front of the air-guiding members 51.

It will be apparent that the invention is not limited to retrofit kits for adapting existing refrigerators, but that new refrigerators may be made incorporating the air guides in accordance with the present invention.

It will be apparent that although in the present embodiment an elongate aerofoil blade has been used in order to provide an air-guiding strip, other air-guiding strips might be employed.

In general any air-guiding strip should preferably be in the form of a continuous elongate strip. However, it may be possible to provide a plurality of smaller air-guiding strips that in effect form an elongate strip that runs across the open front of a refrigerator.

It is preferred that the air-guiding strips have an aerofoil cross-section. However, an air-guiding strip with a rectangular, curved, or oval cross-section might be used and such an air-guiding strip might still result in a reduction in energy consumption by a refrigerator employing air-guiding strips in accordance with the present invention.

Example 1

The invention was initial tested using Computational Fluid Dynamics.

A steady state two dimensional representation of an open-fronted multi-deck refrigerated display cabinet was modeled using Ansys CFX 14.5 CFD code. Heat transfer by convection between the ambient and the refrigerated air curtain was modeled. Buoyancy was modeled. The temperatures of products were not modeled, nor were effects of thermal radiation or humidity.

Both a multi-deck with air-guiding strips and an identical cabinet without air-guiding strips in the form of aerofoils were modelled so that a direct comparison of the effect of air-guiding strips could be made. The numerical mesh and all other modelling parameters were kept as similar as possible, so that only the differences due to the air-guiding strips would be apparent.

Parameters of the model are shown below.

Ambient temperature outside of the cabinet=25° C.
Temperature of air curtain and rear panel flow=−1° C.
Mass flow rate of air curtain=1 kg/s per metre length
Flow rate through rear panel=1 kg/s per metre length
Number of shelves=5+well
Depth of shelves and well=500 mm
Distance between shelves=300 mm
Height of product on shelf=150 mm
Height of shelf=40 mm
Depth of discharge and return grille=100 mm
Aerofoil type=NACA4314 (non-symmetric)
Aerofoil length=40 mm
Distance from aerofoil to shelf=100 mm
Inside of discharge grille in line with edge of shelf
Outside of discharge grille in line with edge of aerofoil

TABLE 1

Temperature and enthalpy increases from discharge to return, domain imbalance, number of iterations and tetrahedral elements.

| Scenario | Temp increase (K) | Enthalpy increase (W/m) | Domain imbalance (W/m) | Number of iterations | Number of tetrahedral elements |
|---|---|---|---|---|---|
| No aerofoils | 3.3 | 650 | 2 | 1170 | 223 615 |
| Aerofoils | 2.2 | 430 | 0.2 | 1180 | 125 805 |

In respect of the results illustrated in Table 1, the temperature and enthalpy increase {per metre length of cabinet} come from entrainment between the warm ambient and cold air curtain. In the case with aerofoils the entrainment is only 66% of the case without aerofoils, showing a reduction of entrainment of 34%. Table 1 also shows the domain imbalance, this is a numerical error, which reduces as the model becomes more accurate. For the results to be valid it should be lower than the differences you are trying to detect, which in this case it is. Table 1 also shows the number of iterations made and the number of tetrahedral elements in each model.

The aerofoils show a reduction in infiltration of 34% compared to not having aerofoils. As the infiltration of a chilled multi-deck display cabinet is approximately 70% of the total load, this would equate to a reduction in heat load of approximately 24%.

A cabinet tested at 25° C. and 60% RH would be expected to have a heat load of approximately 1.6 kW per metre length. Approximately 1.1 kW would be due to entrainment, of which approximately 50°/o would be latent, giving a sensible infiltration of approximately 500 W/m. This is a similar value to that shown by the model.

Example 2

Following the success of the theoretical modeling a real-life physical test was conducted.

A Verco C130 ® refrigerator was subjected to British Standards test BS EN ISO EN ISO EN23953: 2005.

Aerofoils made from folded stainless steel measuring 45 mm in height, and 6 mm in thickness were attached to each shelf with the leading edge of each aerofoil pointing upwards towards the top of the fridge from where the air curtain is ejected. The aerofoils were cut to be the same length as the shelves to which they were fitted. The aerofoils had substantially the same profile as depicted in FIG. 6.

The aerofoils were located at a distance of 85±3 mm between the outer edge of the ticket strip and the inner edge of the aerofoil (minimum gap) and were approximately vertical. The aerofoils were slotted into brackets that were bolted to the ends of the shelves Phase 1 of the tests performed involved running the refrigerator on its normal settings and without any aerofoils attached.

Phase 2 of the tests involved running the refrigerator on the same settings, but with the aerofoils as described above attached to the refrigerator.

Phase 3 of the tests involved keeping the aerofoils on the refrigerator, but altering the settings on the refrigerator such that it produced substantially the same performance as during phase 1 (i.e. without the aerofoils attached to it). The reason for this is that one of the main purposes of the invention is not to improve the temperature performance of a refrigerator (although this may of course be achieved using the invention if desired), but instead is to reduce the energy consumed by refrigerators.

The control settings for the three phases of the test are shown in Table 2.

TABLE 2

Refrigerator control settings.

| | Phase 1 & 2 | Phase 3 |
|---|---|---|
| Temperature setting | −1.0° C. | 0.1 |
| Defrost interval | 6 hours | 6 hours |
| Defrost maximum time | 30 minutes | 30 minutes |
| Defrost termination temperature | 5.0° C. | 5.0° C. |
| Hysteresis/differential | 5.0° C. | 5.0° C. |

Thus, energy consumption can be most reduced by attaching aerofoils to a refrigerator and then changing the settings on the refrigerator such that it produces substantially the same temperature performance as it did without the aerofoils.

TABLE 3

Results of phases 1 to 3 testing (test BS EN ISO EN23953: 2005)

| | Test Results Without Air Guides (Phase 1) | Test Results With Air Guides (Phase 2) | Test Results With Air Guides (Phase 3) |
|---|---|---|---|
| Maximum temperature (° C.) | 7.7 | 7.1 | 7.7 |
| Minimum temperature (° C.) | 0.3 | 0.6 | 1.4 |
| Overall mean (° C.) | 3.8 | 3.8 | 4.4 |
| Mean visible (° C.) | 4 | 4 | 4.7 |
| Average power (W) | 804.9 | 681 | 670.9 |
| Energy 48 h | 19.32 | 16.35 | 16.10 |
| (kWh/8 h) | 4 | 4 | 4.7 |
| % run time | 83.1 | 67.7 | 67.4 |
| TEC/TDA | 11.82 | 10 | 9.85 |
| Energy Reduction | ^^ | 15% | 17% |

TEC/TDA definition: this is the equation used to compare Total Energy Consumption (TEC) with Total Display Area (TOA). The lower this figure is, the better.

As can be seen from Table 3, the aerofoils of the present invention reduce the TEC and therefore improve this figure.

Further, while the average temperatures remain the same between phase 1 and 2 the temperature range has decreased resulting in a decrease of the maximum temperature of 0.6 Degrees C.

Adding the aerofoils resulted in an energy decrease of 15% during phase 2, and 17% in phase 3.

It should be noted that the term aerofoil has the same meaning as the US English word airfoil.

Many variations are possible without departing from the scope of the present invention as set out in the appended claims.

The invention claimed is:

1. A refrigerator, comprising:

a body defining a storage space;

a plurality of shelves disposed within the storage space, each shelf of the plurality of shelves having a front edge;

an air curtain system having at least one air egress and at least one air-recovery ingress, the air curtain system being configured to produce an air curtain in front of the plurality of shelves, the air curtain having a flow direction; and a plurality of asymmetrical airfoils extending across at least part of the body, each airfoil being spaced from the front edge of a corresponding one of the shelves, each airfoil being substantially aligned with the flow direction of the air curtain and located within the air curtain;

each airfoil comprising a pressure surface facing towards the corresponding one of the shelves and a suction surface facing away from the corresponding one of the shelves, so as to create a pressure differential between a first portion of the air curtain located between the pressure surface and the corresponding shelf and a second portion of the air curtain extending from the suction surface away from the corresponding shelf.

2. The refrigerator of claim 1 wherein each airfoil is located substantially vertically beneath the air egress or beneath an outer edge of the air egress.

3. The refrigerator of claim 1 wherein the airfoils are collectively configured to straighten the flow direction of the air curtain towards vertical.

4. The refrigerator of claim 1 wherein each airfoil extends substantially across a full width of the corresponding shelf.

5. The refrigerator of claim 1 wherein each airfoil extends across substantially a full width of the air curtain.

6. The refrigerator of claim 1 further comprising an open front, wherein each airfoil extends across substantially a full width of the open front.

7. The refrigerator of claim 1 wherein a height of each airfoil is one or more of: between 25 and 60 mm, between 35 and 50 mm, and between 40 and 45 mm.

8. The refrigerator of claim 1 wherein the airfoil has a chord length, and the chord length is one or more of: between 25 and 60 mm, between 35 and 50 mm, and between 40 and 45 mm.

9. The refrigerator of claim 1 wherein each airfoil is attached to the corresponding shelf or a support for that shelf.

10. The refrigerator of claim 1 wherein each airfoil is attached to the refrigerator by a plurality of brackets.

11. The refrigerator of claim 1 wherein each airfoil comprises a housing for displaying at least one product label or a plurality of product labels.

12. A refrigerator, comprising:

a body defining a storage space;

a plurality of shelves disposed within the storage space, each shelf of the plurality of shelves having a front edge;

an air curtain system having at least one air egress and at least one air-recovery ingress, the air curtain system being configured to produce an air curtain in front of the plurality of shelves, the air curtain having a flow direction; and a plurality of air-guiding strips extending across at least part of the body, each air-guiding strip being spaced from the front edge of a corresponding one of the shelves, each air-guiding strip being substantially aligned with the flow direction of the air curtain and located within the air curtain so as to stabilize a flow of the air curtain and straighten a flow of the air curtain;

each air-guiding strip comprising a backing portion and a front portion, the front portion comprising a housing for displaying one or more product labels, wherein each backing portion and front portion together comprise an asymmetrical airfoil, each asymmetrical airfoil comprising a pressure surface facing towards the corresponding one of the shelves and a suction surface facing away from the corresponding one of the shelves.

13. The refrigerator of claim 12 further comprising an open front, wherein each air-guiding strip extends across substantially a full width of the open front.

14. The refrigerator of claim 12 wherein the front portion of each air-guiding strip is formed of a transparent plastics material.

15. The refrigerator of claim 12 wherein each air-guiding strip is one or more of: at least 2 mm in thickness, at least 4 mm in thickness, at least 6 mm in thickness, at least 8 mm in thickness, at least 10 mm in thickness, at least 12 mm in thickness, or at least 14 mm in thickness.

16. A method of improving the efficiency of a refrigerator which comprises a body defining a storage space, a plurality of shelves disposed within the storage space, each shelf of the plurality of shelves having a front edge, and an air curtain system having at least one air egress and at least one air-recovery ingress, the air curtain system being configured to produce an air curtain in front of the plurality of shelves, the air curtain having a flow direction, of the method comprising:

fitting within the body a plurality of asymmetrical airfoils each extending across at least part of the body, such that each airfoil is spaced from the front edge of a corresponding one of the shelves, each airfoil being substantially aligned with the flow direction of the air curtain and located within the air curtain;

wherein each airfoil comprises a pressure surface facing towards the corresponding one of the shelves and a suction surface facing away from the corresponding one of the shelves, so as to create a pressure differential between a first portion of the air curtain located between the pressure surface and the corresponding shelf and a second portion of the air curtain extending from the suction surface away from the corresponding shelf.

17. The method of claim 16 wherein the airfoils are collectively arranged to stabilize a flow of the air curtain and to guide air moving out of a stream of the air curtain back into the stream.

18. The method of claim 16 wherein each airfoil is fitted substantially vertically beneath the air egress or beneath an outer edge of the air egress.

19. The method of claim 16 wherein the airfoils are fitted so that collectively they straighten the flow direction of the air curtain towards vertical.

* * * * *